United States Patent [19]

Itakura

[11] 4,180,377

[45] Dec. 25, 1979

[54] VALVE ELEMENT FOR AN AIR PUMP

[75] Inventor: Tsuyoshi Itakura, Tokyo, Japan

[73] Assignee: Itakura Soki Co., Ltd., Tokyo, Japan

[21] Appl. No.: 833,582

[22] Filed: Sep. 15, 1977

[30] Foreign Application Priority Data

Dec. 14, 1976 [JP] Japan ..... 51-167612

[51] Int. Cl.[2] ..... F04B 43/04

[52] U.S. Cl. ..... 417/413; 137/855; 417/566

[58] Field of Search ..... 417/412, 413, 566; 137/855, 856, 857, 858

[56] References Cited

U.S. PATENT DOCUMENTS

| | | | |
|---|---|---|---|
| 2,169,827 | 8/1939 | Whitted | 417/413 |
| 2,253,206 | 8/1941 | Farrow et al. | 417/413 |
| 2,747,922 | 5/1956 | Gibson | 137/855 X |
| 2,777,397 | 1/1957 | Atkinson | 137/855 X |
| 2,809,589 | 10/1957 | Randolph | 417/413 |
| 2,826,448 | 3/1958 | Jones | 137/855 X |
| 3,099,998 | 8/1963 | Fisher | 137/855 |
| 3,819,306 | 6/1974 | Russell | 417/566 |

*Primary Examiner*—Carlton R. Croyle
*Assistant Examiner*—Edward Look
*Attorney, Agent, or Firm*—Eliot S. Gerber

[57] ABSTRACT

A valve element for a small sized air pump. The valve element has legs, each of which are tightly secured within holes of valve-beds of a valve casing. A longitudinal hole is formed within each of the legs. The hole of the leg is opened at one end and closed at the other such that the hole terminates at a level horizontal to the lower surface of the valve-beds when the valve element is assembled.

4 Claims, 5 Drawing Figures

VALVE ELEMENT FOR AN AIR PUMP

BACKGROUND OF THE INVENTION

The present invention relates to a valve element used for a small sized air pump which sends air into, for example, a water tank for an ornamental, appreciative tropical fish.

The small sized air pump used in the aforementioned field is operated by vibrating a drum-like membrane by an electromagnet to thereby permit a function of a valve. In the conventional air pump of the field, inlet and outlet valves, each of which has a tongue, valve body and a leg, are tightly positioned on beds of a pump casing such that the leg of the valve is inserted into, and tightly connected to, a hole formed on the bed. According to the conventional valves, however, the applicant has found some disadvantages such that the valves are swayed from side to side or pivoted about the leg during the operation of the air pump.

An attempt has been made to improve the aforementioned valves. In the attempt, sleeves are formed integral with opposite sides of a round shaped tongue, wherein each of the sleeves has a leg for a tight engagement with two holes of the bed. In this valve structure, the tongue is secured on the bed by means of two legs of the sleeves. However, the applicant has found that the valve of this configuration produces a noise in operation though the sleeves of the valve are tightly connected to the bed of the valve casing. The applicant believes that the aforementioned noise is due to the structure that the tongue is firmly secured to the bed by the two sleeves and legs. Furthermore, it is awkwardly troublesome to assemble the valve into the pump casing since two legs, which are made of resilient material, should be inserted into the holes of the beds.

Accordingly, an object of the present invention is to provide an improved valve element which can be assembled readily.

Another object of the present invention is to provide an improved valve element which will not be swayed or pivoted during the operation of an air pump.

Other objects and features of the present invention will become apparent from the detailed description of preferred embodiments thereof, which is made with reference to the accompanying drawings.

DETAILED DESCRIPTION OF THE INVENTION

Figure 1:
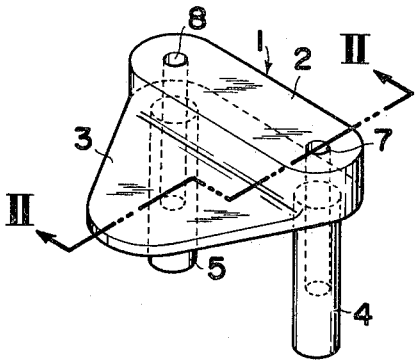
FIG. 1 is a perspective view of the valve element embodying the present invention.
Figure 2:
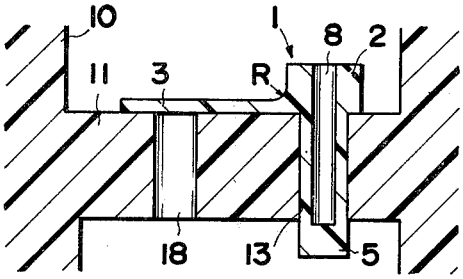
FIG. 2 is a sectioned view of the valve element taken along II—II of FIG. 1, showing that the valve element is secured on a bed of a casing.

Like reference numerals represent like parts in the figures of the drawing. In FIGS. 1 and 2, a valve element 1 made of a resilient material such as a synthetic resin or rubber has a body 2, tongue 3 has cylindrical legs 4 and 5. The tongue 3 is formed integral with the body and extends laterally from the lower side of the body 2. The legs 4 and 5 are formed integral with the body 2 and extends vertically from the bottom of the body. The valve element 1 further comprises holes 7 and 8 which are opened at the upper end of the body 2 and ends at the lower portion of the legs 4 and 5, as well illustrated in FIG. 2. The starting portion of the laterally extended tongue 3 is round shaped at the upper portion as illustrated by R (FIG. 2) and has a thickness slightly larger than the thickness of a tip portion thereof so that the tongue provides a desired resiliency.

The legs 4 and 5 are formed longer than a thickness of beds 11 and 12 of a valve casing 10 such that the holes 7 and 8 of the legs have a depth of substantially horizontal level of the bottom surface of the beds 11 and 12 when the valve elements are assembled. The legs 4 and 5 have an outer diameter slightly larger than holes 13 and 14 which are formed on the beds 11 and 12 of the valve casing 10.

The valve casing 10 will be described with reference to FIGS. 3 and 4. The casing 10 is made of plastics and has a tubular member 16 at the central or axial portion thereof and beds 11 and 12 which are formed integral with the tubular member 16, and the casing 10. Each of the beds 11 and 12 has holes 13 and 15 for securing the legs 4, 5 therein. Holes 18 and 19 are formed on the beds 4 and 5, respectively, for the purpose of an air-delivery. A cup-like membrane 20 made of a resilient material as rubber or the like is hermetically connected to the casing 10 to form a chamber 21. The membrane 20 has an extended central portion **20*a* and is connected to an electromagnet 22 through a bar member 23. An inlet chamber 24 and an outlet chamber 25 are formed within the casing 10 such as these chambers 24 and 25 are confined by the casing and the tubular member 16. The lower end of the casing 10 is sealed, with a cover member 26. An inlet nozzle 27 and an outlet nozzle 28 are connected to the inlet chamber 24 and the outlet nozzle 25**, respectively.

The legs 4 and 5 of the valve element 1 are forcibly and snugly inserted into the holes 13 and 14 of the beds 11 and 12 such that the end portion of the legs extends further through the holes 13, 14 as illustrated in FIG. 2. In order to insert the legs 4, 5 into the holes 13, 14 of the beds to assemble the valve element, a desired tool (not shown) having pins may be used in such a manner that the pins are inserted into the holes 7, 8 of the legs and then the tool is pushed toward the beds of the casing until the legs 4, 5 are fully and tightly inserted into the holes 13, 14 of the bed. After the valve elements are snugly secured in position, the cup-like membrane 20 and the cover member 26 are connected to the casing as illustrated in FIG. 3.

Figure 3:
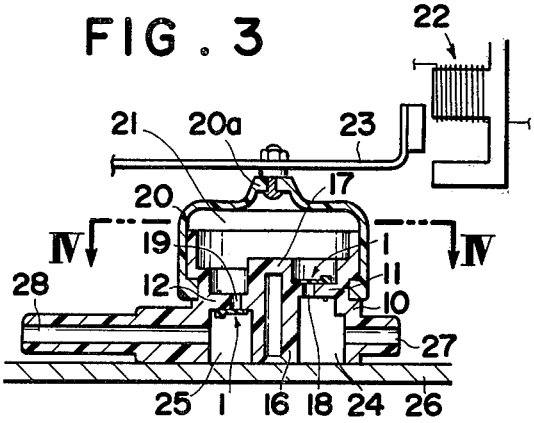
FIG. 3 shows an air pump in section, in which the valves of the present invention are secured.
Figure 4:
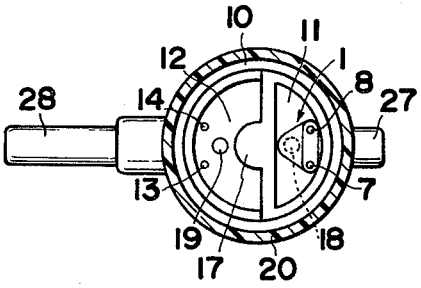
FIG. 4 is a sectioned view of the air pump taken along IV—IV of FIG. 3.

In operation, the electromagnet 22 is switched on to vibrate the bar member 23 so as to vibrate the membrane 20 as illustrated by phontom lines of FIG. 3. Thus, the tongues 3 of the valve elements are vibrated such that the holes 18, 19 of the beds 11, 12 are alternately opened and closed to thereby pump out from the outlet nozzle 28 an air, which is introduced from the inlet nozzle 27.

Figure 5:
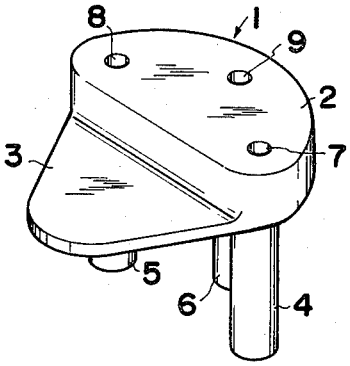
FIG. 5 is a perspective view of the valve according to another embodiment of the present invention.

In FIG. 5 which shows another embodiment of the present invention, the valve element 1 has another leg 9 which extends in parallet to 1 and spaced from the other legs 4, 5. Each bed of the casing 10 has three holes (not shown) for tightly securing the three legs 7, 8, 9 therein. The other construction and assembly of the valve element is quite similar with that of the first embodiment described with reference to FIGS. 1–4.

According to the present invention, the valve element has a plurality of legs each of which has an outer diameter slightly larger than the hole 13, 14 of the bed and longer than the thickness of the bed, and a hole which terminates at the horizontal level of the bottom of the bed when the valve element is assembled. Thus, the legs are tightly engaged with the bed of the casing to provide a reliable operation of a valve element.

Though the present invention has been described with reference to the preferred embodiments thereof, many modifications and alteration may be made within the spirit of the present invention.

What I claim is:

1. In a valve element for an air pump having a cylindrical casing, a resilient membrane connected to one side of said casing, a cover member connected to the other side of said casing and an electromagnetic device for vibrating said membrane, said casing having beds for securing the valve element on one surface thereof, holes at said beds for an air-flow and inlet and outlet nozzles, and cylindrical holes in said beds for the fixing of said valve elements, an improvement of said valve element wherein said valve element has a body portion, a tongue portion and a plurality of cylindrical legs formed integral with said body portion and parallel to each other, said legs being uniform cross-sectional cylinders without a flange-holding groove, said legs each having a longitudinal hole which starts at one side of the body portion to form an opening of said hole and is closed at the end of said leg, said hole having a depth such that the hole terminates at a level substantially horizontal to the other surface of said beds when said valve element is assembled within said casing, said legs being force-fitted into engagement with the sidewalls of said cylindrical holes.

2. The valve element in accordance with claim 1, in which said tongue portion is thicker at its starting portion than its extended tip portion.

3. The valve element in accordance with claim 1, in which said valve element is made of a synthetic resin material.

4. The valve element in accordance with claim 1, in which said legs have length larger than the thickness of said beds.

* * * * *